United States Patent [19]

Nomura

[11] Patent Number: 4,522,112

[45] Date of Patent: Jun. 11, 1985

[54] SWASH-PLATE TYPE COMPRESSOR HAVING IMPROVED LUBRICATION OF SWASH PLATE AND SHOES

[75] Inventor: Hiroshi Nomura, Konan, Japan

[73] Assignee: Diesel Kiki Co., Ltd., Tokyo, Japan

[21] Appl. No.: 482,615

[22] Filed: Apr. 6, 1983

[30] Foreign Application Priority Data

Apr. 26, 1982 [JP] Japan ..... 57-60804[U]

[51] Int. Cl.[3] ..... F01M 1/06; F04B 1/16

[52] U.S. Cl. ..... 92/71; 92/158; 417/269

[58] Field of Search ..... 92/71, 153, 158, 160; 417/269; 74/60

[56] References Cited

U.S. PATENT DOCUMENTS 1,487,965 3/1924 Michell ..... 92/71
3,057,545 10/1962 Ransom et al. ..... 417/269
3,950,057 6/1976 Kometani et al. ..... 92/160
4,229,145 10/1980 Isizuka ..... 417/269

FOREIGN PATENT DOCUMENTS 2482 1/1982 Japan ..... 74/60
351316 6/1931 United Kingdom ..... 74/60

*Primary Examiner*—William L. Freeh
*Attorney, Agent, or Firm*—Frishauf, Holtz, Goodman & Woodward

[57] ABSTRACT

Double-headed pistons received within cylinder bores in the cylinder block are in engagement with the swash plate via shoes and balls. The pistons each have its intermediate bridge portion formed with at least one lubricating oil-guiding hole extending therethrough from a side surface of the same portion facing the inner peripheral surface of the cylinder bore to the opposite side surface facing the outer fringe of the swash plate. The bridge portion of each piston may also be formed with an axially extending lubricating oil-guiding groove joined at one end to the lubricating oil-guiding hole.

6 Claims, 3 Drawing Figures

SWASH-PLATE TYPE COMPRESSOR HAVING IMPROVED LUBRICATION OF SWASH PLATE AND SHOES

BACKGROUND OF THE INVENTION

This invention relates to swash-plate type compressors for use in air conditioners for vehicles or the like, and more particularly to improvements in the pistons used in such compressors to provide improved lubrication of sliding portions of the swash plate and the shoes interposed between the pistons and the swash plate.

In a swash-plate type compressor of this kind in general, double-headed pistons are disposed to reciprocatingly move within their cylinder bores in unison with the rotation of the swash plate secured aslant on the drive shaft, for fluid compressing action in cooperation with the suction valves and the discharge valves. Balls and shoes are slidably interposed between the swash plate and the pistons to smoothly convert the rotational motion of the swash plate into corresponding reciprocating motions of the pistons. During the rotation of the swash plate, the sliding portions of the swash plate, shoes, balls and pistons undergo severe friction, requiring permanent supply of lubricating oil. In order to supply lubricating oil to the above sliding portions, the rotating swash plate upwardly splashes lubricating oil stored in an oil reservoir at the bottom of the cylinder block, and the resulting misty oil is supplied to the sliding portions. However, according to this manner, sometimes a required oil supply amount cannot be achieved. Particularly when the swash plate is rotating at a high speed, the shoes slidingly move on the swash plate at a correspondingly high speed, which can result in a shortage of lubricating oil supplied to their sliding surfaces, and sometimes the resulting high frictional heat causes seizure of these parts.

OBJECT AND SUMMARY OF THE INVENTION

It is the object of the invention to provide a swash-plate type compressor in which the pistons are formed with lubricating oil-guiding holes through which lubricating oil can be directly supplied to the sliding surfaces of the swash plate, shoes and balls, thereby avoiding seizure of the sliding surfaces and accordingly improving the effective lives of these parts.

A swash-plate type compressor according to the invention comprises pistons which each have a pair of heads and an intermediate bridge portion intervening between the heads and having a first side surface facing the inner peripheral surface of the cylinder bore and forming part of the outer peripheral surface of the piston and a second side surface opposite to the first side surface and facing the outer fringe of the swash plate. The intermediate bridge portion has at least one lubricating oil-guiding hole extending therethrough from the first side surface to the second side surface.

Preferably, the first side surface of the intermediate bridge portion of the piston is formed with a lubricating oil-guiding groove which axially extends and joins at one end the above-mentioned lubricating oil-guiding hole.

The above and other objects, features and advantages of the invention will be more apparent from the ensuing detailed description taken in conjunction with the accompanying drawings.

DETAILED DESCRIPTION

The invention will now be described in detail with reference to the drawings.

Figure 1:
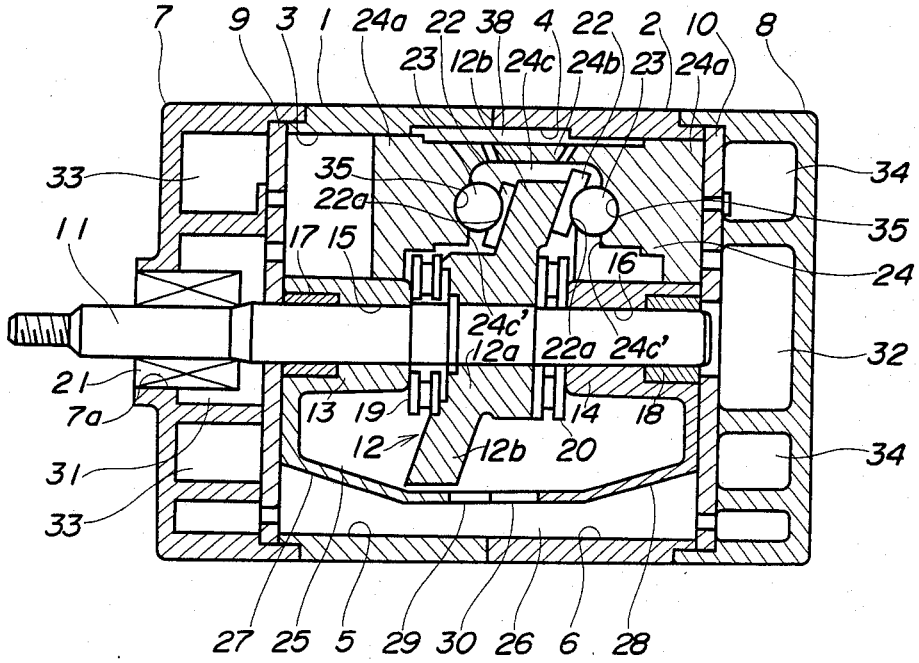
FIG. 1 is a schematic longitudinal sectional view of a swash-plate type compressor according to an embodiment of the invention.

Referring to FIG. 1, there is illustrated an embodiment of a swash-plate type compressor according to the invention, which is adapted for use in air conditioners for vehicles. A pair of cylinder blocks 1 and 2 are combined together in axial alignment with their axes disposed horizontally. The paired cylinder blocks 1, 2 are formed, respectively, with a plurality of cylinder bores 3 and 4 axially aligned, and through holes 5 and 6 axially aligned and circumferentially arranged between adjacent ones of the cylinder bores, and of which only one pair of each are illustrated in FIG. 1. Cylinder heads 7 and 8 are secured to the opposite ends of the cylinder blocks 1, 2, with valve plates 9 and 10 interposed therebetween, and in such a manner that the junctions between the cylinder heads, the cylinder blocks and the valve plates are maintained in an airtight state by sealing means, not shown.

A drive shaft 11 axially penetrates through axially aligned through holes 15 and 16 formed through bosses 13 and 14 of the cylinder blocks 1, 2, on an intermediate portion of which is rigidly fitted a swash plate 12 arranged within a swash plate chamber 25 defined within the cylinder blocks. One end portion of the drive shaft 11 extends to the outside through a sealing means 21 fitted in a central through hole 7*a* of the cylinder head 7 on the front side and disposed for coupling to a driving means, not shown. Bearings 17 and 18 are arranged in the through holes 15, 16 in a manner fitted on the drive shaft 11 to radially support same. Thrust bearings 19 and 20 are interposed between the bosses 13, 14 of the cylinder blocks 1, 2 and the boss 12*a* of the swash plate 12 to axially support the swash plate.

A plurality of double-headed pistons 24, only one of which is shown, are slidably received within the respective cylinder bores 3, 4 in the cylinder blocks 1, 2 and each disposed in engagement with an outer fringe 12*b* of the swash plate 12 via shoes 22 and 22 and balls 23 and 23.

The swash plate chamber 25 communicates with all the cylinder bores 3, 4, and below which is arranged an oil pan 26 formed in lowermost ones of the through holes 5, 6. The swash plate chamber 25 and the oil pan 26 are separated from each other by partition walls 27 and 28 axially and horizontally extending from the abutting inner ends of the cylinder blocks to the respective valve plates 9, 10, and communicated with each other via through holes 29 and 30 formed through the same partition walls.

The cylinder heads 7, 8 are formed therein with refrigerant suction chambers 31 and 32 communicating with respective suction ports, not shown, and refrigerant discharge chambers 33 and 34 arranged around the respective suction chambers 31, 32 and communicating with respective discharge ports, not shown.

The double-headed pistons 24 are each formed of a one-piece member having a pair of heads 24*a* and 24*a*, and an intermediate bridge portion 24*b* in the form of a plate. The bridge portion 24*b* has a backside or outer side surface 24*b'* forming part of the outer peripheral surface of the piston and facing the inner peripheral surface of the cylinder bore 1, 2, and a front side or inner side surface 24*b''* opposite to the backside surface 24*c'* and defining a recess 24*c* in cooperation with opposite inner end faces 24*c'* and 24*c'* of the heads 24*a*, 24*a* and opening radially inward. The heads 24*a*, 24*a* each have its outer peripheral surface formed with an annular groove 24*a'* in which a piston ring 39 is fitted. In the aforementioned recess 24*c* is received the outer fringe 12*b* of the swash plate 12. The recess 24*c* has its opposite inner end faces 24*c'*, 24*c'* which are formed therein with semispherical pockets 35 and 35 in which the balls 23, 23 are slidably received. Interposed between the balls 23, 23 and the swash plate 12 are the aforementioned shoes 22, 22 which have one side surface disposed in slidable contact with corresponding opposite side surfaces of the outer fringe 12*b* of the swash plate 12, and the other side surfaces formed with semispherical pockets 22*a* and 22*a* in which the balls 23, 23 are slidably received. Thus, the balls 23 and the shoes 22 cooperatively maintain the pistons 24 and the swash plate 12 in slidable engagement with each other.

Figure 2:
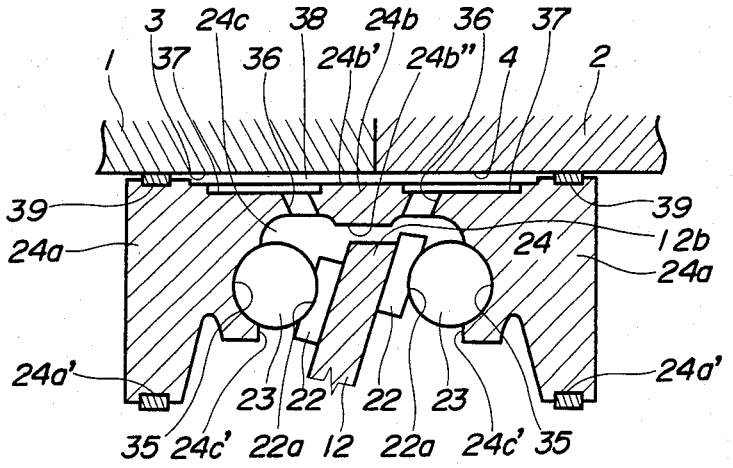
FIG. 2 is a fragmentary longitudinal sectional view of a piston used in the compressor of FIG. 1 and parts engaging therewith.

As clearly shown in FIG. 2, the intermediate bridge portion 24*b* of each of the pistons 24 is formed with two lubricating oil-guiding holes 36 and 36 extending therethrough from the backside surface 24*b'* to the inner side surface 24*b''* facing the outer fringe 12*b* of the swash plate 12. The above lubricating oil-guiding holes 36, 36 are arranged axially symmetrically with respect to the outer fringe 12*b* and have their axes directed toward the same outer fringe 12*b*.

Figure 3:
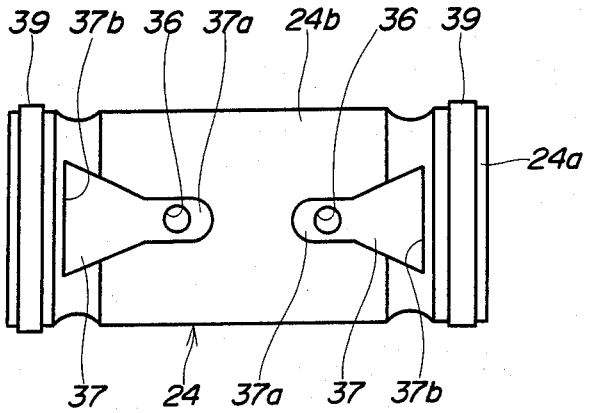
FIG. 3 is a plan view showing a backside surface of the same piston.

Preferably, as shown in FIG. 3, the backside surface 24*b'* of the bridge portion 24*b* is formed therein with two lubricating oil-guiding grooves 37 and 37 each having a flat bottom surface, which serve to promote the introduction of blow-by gas into the lubricating oil-guiding holes 36, 36. These grooves 37, 37 open in a clearance 38 between the backside surface 24*b'* and the inner peripheral surface of the cylinder bore 1, 2, and each have an inner end 37*a* joining a corresponding end of the associated lubricating oil-guiding hole 36 in a manner surrounding the same end. The grooves 37, 37 axially and inwardly extend from the respective outer end 37*b* at the junctions between the heads 24*a*, 24*a* and the bridge portion 24*b* and gradually increase in width toward the junctions so that during the compression stroke of the piston 24, blow-by gas can easily be introduced into the lubricating oil-introducing holes 36, 36 as it is spilled into the clearance 38 through the clearance between the piston rings 39 in the heads 24*a*, 24*a* and the cylinder bores 3, 4.

The operation of the swash-plate type compressor constructed as above, particularly the lubrication of same, will now be described. As the swash plate 12 rotates in unison with the rotation of the drive shaft 11, the pistons 24 reciprocatingly move within their respective cylinder bores 3, 4 to suck refrigerant from the suction chambers 31, 32 through the valve plates 9, 10 and compress and discharge same into the discharge chambers 33, 34 through the valve plates 9, 10, and the discharged compressed refrigerant is delivered into a refrigerating circuit, not shown, through the discharge ports, not shown.

During the above compressing action, lubricating oil stored in the oil pan 26 below the swash plate chamber 25 is upwardly splashed by the rotating swash plate 12, and the resulting misty oil is supplied to the sliding portions of the swash plate 12, the shoes 22, 22, the balls 23, 23 and the pistons 24 to lubricate same.

At the same time, as the pistons 24 rotate in unison with the rotating swash plate 12, blow-by gas which contains lubricating oil mixed therein passes through the clearances between the heads of the pistons and the cylinder bores into the clearance 38 between the intermediate bridge portions 24*b* of the pistons and the cylinder bores 3, 4, and then flows into the swash plate chamber 25 via the opposite lateral edges of the bridge portions 24*b*. Besides, as the swash plate 12 rotates, a flow of refrigerant gas takes place in the recess 24*c* in the rotating direction of the swash plate 12. As a consequence, the pressure acting upon the inner side surface 24*b''* of the bridge portion 24*b* drops below that prevailing in the clearance 38 so that the blow-by gas in the clearance 38 is guided due to the differential pressure along the lubricating oil-guiding grooves 37, 37 and through the lubricating oil-guiding holes 36, 36 into the recess 24*c* at a zone in the vicinity of the inner side surface 24*b''* of the bridge portion 24*b*. Since the lubricating oil-guiding holes 36, 36 have their axes directed toward the outer fringe 12*b* of the swash plate 12 as previously noted, an adequate amount of the blow-by gas is brought into contact with the swash plate 12, the shoes 22, 22 and the balls 23, 23 as it is delivered into the recess 24*c* through the holes 36, 36, whereby the lubricating oil contained in the blow-by gas lubricates the sliding surfaces of these parts sufficiently. Thus, even during high speed rotation of the swash plate 12, seizure of the sliding parts, particularly, that of the shoes 22, 22 on the sliding surfaces of the outer fringe 12*b* of the swash plate 12, can be prevented, improving the effective lives of the parts.

Further, the invention may be easily applied to a conventional swash-plate type compressor provided with double-headed pistons, merely by adding very minor alterations thereto.

The diameter, configuration, location, number, etc. of the lubricating oil-guiding holes 35, 35 are not limited to those illustrated, but may be suitably chosen so as to achieve a proper amount of lubricating oil to be supplied to the sliding parts, depending upon the percentage of lubricating oil in the blow-by gas, the flow rate of the blow-by gas, etc. Also, the configuration, size, location, etc. of the lubricating oil-guiding grooves 37, 37 are not limited to those illustrated, but may be suitably designed in dependence on the size of the clearance 38, etc. so as to achieve high efficiency of introduction blow-by gas into the recess 24*c* through the lubricating oil-guiding holes 36, 36.

Obviously many modifications and variations of the present invention are possible in the light of the above teachings. It is therefore to be understood that within the scope of the appended claims the invention may be practiced otherwise than as specifically described.

What is claimed is:

1. A swash-plate type compressor comprising:

a cylinder block having at least one cylinder bore extending axially thereof and having an inner peripheral surface;

a swash-plate arranged in said cylinder block and rotatable relative thereto, said swash plate including an outer fringe having opposite side surfaces;

at least one double-headed piston slidably received within said cylinder bore and having an outer peripheral surface, said piston including a pair of heads, each head having an inner end face, and an intermediate bridge portion intervening between said heads, said intermediate bridge portion having a first side surface forming part of said outer peripheral surface of said piston and facing said inner peripheral surface of said cylinder bore, and a second inner side surface opposite to said first side surface and facing said outer fringe of said swash plate;

said second side surface of said intermediate bridge portion defining a recess in cooperation with opposite inner end faces of said heads; and at least two pairs of shoe and ball assemblies interposed between said piston and said outer fringe of said swash plate and maintaining said swash plate in rotatable engagement with said piston, each of said shoe and ball assemblies including a shoe disposed in slidable contact with a corresponding one of said opposite side surfaces of said outer fringe of said swash plate and a ball disposed in slidable contact with said piston and maintaining said shoe on said corresponding one of said opposite side surfaces;

said intermediate bridge portion of said piston having at least one lubricating oil-guiding hole extending therethrough from said first side surface to said second inner side surface for guiding lubricating oil from said first side surface to said second inner side surface;

said recess receiving therein said outer fringe of said swash plate and said shoe and ball assemblies;

said lubricating oil-guiding hole opening in said recess for guiding lubricating oil to the inner side surface of said bridge portion, to at least said outer fringe of said swash plate and to said shoe and ball assemblies;

a lubricating oil-guiding groove formed in said first side surface of said intermediate bridge portion of said piston, said lubricating oil-guiding groove extending axially of said piston and having one end joining said lubricating oil-guiding hole, said lubricating oil-guiding groove having another end and gradually increasing in width toward said another end thereof.

2. A swash-plate type compressor as claimed in claim 1, wherein said lubricating oil-guiding hole has an axis thereof directed toward said outer fringe of said swash plate.

3. A swash-plate type compressor as claimed in claim 1, wherein said lubricating oil-guiding hole comprises a pair of holes arranged axially symmetrical with respect to said outer fringe of said swash plate.

4. A swash-plate type compressor comprising:

a cylinder block having at least one cylinder bore extending axially thereof and having an inner peripheral surface;

a swash-plate arranged in said cylinder block and rotatable relative thereto, said swash plate including an outer fringe having opposite side surfaces;

at least one double-headed piston slidably received within said cylinder bore and having an outer peripheral surface, said piston including a pair of heads, each head having an inner end face, and an intermediate bridge portion intervening between said heads, said intermediate bridge portion having a first side surface forming part of said outer peripheral surface of said piston and facing said inner peripheral surface of said cylinder bore, and a second inner side surface opposite to said first side surface and facing said outer fringe of said swash plate;

said second side surface of said intermediate bridge portion defining a recess in cooperation with opposite inner end faces of said heads; and at least two pairs of shoe and ball assemblies interposed between said piston and said outer fringe of said swash plate and maintaining said swash plate in rotatable engagement with said piston, each of said shoe and ball assemblies including a shoe disposed in slidable contact with a corresponding one of said opposite side surfaces of said outer fringe of said swash plate and a ball disposed in slidable contact with said piston and maintaining said shoe on said corresponding one of said opposite side surfaces;

said intermediate bridge portion of said piston having at least one lubricating oil-guiding hole extending therethrough from said first side surface to said second inner side surface for guiding lubricating oil from said first side surface to said second inner side surface;

said recess receiving therein said outer fringe of said swash plate and said shoe and ball assemblies;

said lubricating oil-guiding hole opening in said recess for guiding lubricating oil to the inner side surface of said bridge portion, to at least said outer fringe of said swash plate and to said shoe and ball assemblies;

a lubricating oil-guiding groove formed in said first side surface of said intermediate bridge portion of said piston, said lubricating oil-guiding groove extending axially of said piston and having one end joining said lubricating oil-guiding hole, said lubricating oil-guiding groove having another end located at a junction between one of said heads of said piston and said intermediate bridge portion thereof.

5. A swash-plate type compressor as claimed in claim 4, wherein said lubricating oil-guiding hole has an axis thereof directed toward said outer fringe of said swash plate.

6. A swash-plate type compressor as claimed in claim 4, wherein said lubricating oil-guiding hole comprises a pair of holes arranged axially symmetrical with respect to said outer fringe of said swash plate.

* * * * *